United States Patent [19]

Kurita

[11] Patent Number: 4,642,825

[45] Date of Patent: Feb. 17, 1987

[54] CONTROL APPARATUS FOR CLINIC BED

[75] Inventor: Masaya Kurita, Kanagawa, Japan

[73] Assignee: Fuji Electric Co., Ltd., Kawasaki, Japan

[21] Appl. No.: 752,564

[22] Filed: Jul. 8, 1985

[51] Int. Cl.[4] ..... A47C 27/08

[52] U.S. Cl. ..... 5/453; 128/400

[58] Field of Search ..... 5/453, 449, 469; 165/25; 128/400; 361/103; 62/161; 219/510

[56] References Cited

U.S. PATENT DOCUMENTS

| | | | |
|---|---|---|---|
| 3,866,606 | 2/1975 | Hargest | 5/453 X |
| 3,916,256 | 10/1975 | Kotani | 361/103 |
| 4,442,885 | 4/1984 | Matsuzaki | 165/25 |
| 4,483,029 | 11/1984 | Paul | 5/453 |

*Primary Examiner*—William E. Wayner

*Attorney, Agent, or Firm*—Finnegan, Henderson, Farabow, Garrett & Dunner

[57] ABSTRACT

A control apparatus for a clinic bed so constructed as to make the air pressurized by air pressurizing means upwardly escape through a diffuser board dotted with a number of small openings and support the human body by floating the body on a bead mattress formed with beads caused to circulate by the flow of the escaped air, the control apparatus comprising excessively high temperature detecting means for detecting the bead temperature exceeding a predetermined level and producing an excessively high temperature warning signal and load releasing means for continuously or intermittently cutting off an energizing circuit for means for driving the air pressurizing means while the excessively high temperature warning signal is produced, the improvement wherein the control apparatus further comprises operational instruction output means for giving instructions concerning energizing the means for driving the air pressurizing means while the excessively high temperature warning signal is produced, closed circuit holding means for closing and holding the energizing circuit according to the instructions, and resetting means for resetting the operation of the closed circuit holding means through reset signal output means after the closing and holding operation is performed.

5 Claims, 4 Drawing Figures

CONTROL APPARATUS FOR CLINIC BED

BACKGROUND OF THE INVENTION

This invention relates to a control apparatus for a clinic bed (also called the "fluidized bed") arranged to have a section housing fine granular substances (beads) driven to circulate by the flow of the air pressurized to upwardly escape through a diffusion plate and used to bear the human body thereon for medical treatment, and more particularly, to a control apparatus for controlling the operation of a clinic bed when the beads stored therein acquire a high temperature.

Referring to FIG. 1, the construction and operation of a clinic bed of this kind will be outlined first. In the accompanying drawings, like reference characters designate like or corresponding parts throughout.

In FIG. 1(A), there is shown a bed comprising a ring compressor 1 for pressurizing external air AO, a motor la for driving the ring compressor 1, a heat exchanger HC for cooling the air pressurized by the ring compressor 1 and for keeping it at a predetermined temperature, a fan F for sending heat exchanging air to the heat exchanger HC, and an airtight chamber 2 for spreading the pressurized air introduced through an air duct D over the under surface of a diffuser board 3. The diffuser board 3 is a plate-like body made of a porous material and dotted with a number of minute openings through which the pressurized air A1 within the airtight chamber 2 is allowed to escape upwardly and diffuse as escaped air A2. The bed also includes a mattress 5 (bead mattress) formed with fine granular substances such as beads caused to flow by the escaped air A2, a tank 4 housing the bead mattress 5 and the diffuser board 3 and also incorporating the airtight chamber 2, and a cloth sheet S having meshes finer than the grain size of the bead and being used to cover the surface of the bead mattress and allow the air A2 to escape therethrough while preventing the beads from being lost into the air. When the human body is put to the bed and made to touch the sheet S, it also serves for gauze and a bandage.

Fluidized beds have mainly been used to facilitate the regrowth of the skin of patients suffering from being badly burned and to protect those confined to their beds for a long time from forming bedsores because such beds are useful for preventing interruption in blood circulation due to localized pressure against the human body. When a patient is laid on the fluidized-bead mattress 5 through the sheet S, the whole body of the patient is supported under uniform pressure applied thereto and consequently the pressure applied to the surface of the body for supporting the given weight is minimized. As a result, the interruption in blood circulation caused by the constriction of peripheral blood vessels can be prevented because the pressure applied to the skin is eased and not only irregular but also biased pressure distribution is less likely to occur.

FIG. 1(B) shows an example of the state of the human body floated on the surface of the bead mattress. The human body BH is placed on the fluidized-bead mattress 5 which supports the body in such a manner as to make the body sag in the mattress 5 as deep as possible to the extent that medical treatment is unobstructed. The equivalent specific gravity of the fluidized-bead mattress 5, for instance, is approximately 1.29 and the human body is made to sag roughly as shown in FIG. 1(B), whereby the human body BH is supported by the bead mattress 5 in its wide contact area proportionate to the sagged portion. Thus the pressure applied to the surface of the body can be decreased.

The temperature of the bead mattress 5 of the fluidized bed must be kept at a suitable predetermined level even though that of the external air AO changes. In order to keep the temperature constant, a temperature regulator (not shown) is used to turn ON and OFF the cooling fan F of the heat exchanger HC. However, in case the temperature of the bead mattress 5 should exceed 40° C. for some reason, the supply of the heated pressurized air A1 is stopped or controlled for the safety of the patient using a thermostat responding to excessively high temperatures by stopping the flow of the air (interruption of the operation of the ring compressor 1) or allowing the intermittent flow thereof (intermittent operation of the ring compressor 1).

It may be still necessary, if circumstances require medically, to operate the fluidized bed continuously even when the temperature of the bead mattress 5 has exceeded 40° C. Moreover, it has often actually been the case with the fluidized bed that its continuous operation is desired to lower the temperature of the bead mattress 5 as quickly as possible when the beads stored in an atmosphere having temperatures exceeding 40° C. are supplied to the bead mattress 5 accidentally. Thus the problem is that the conventional clinic bed may not properly function in case the temperature of its bead mattress 5 exceeds 40° C.

SUMMARY OF THE INVENTION

An object of the present invention is to provide a control apparatus capable of eliminating the aforementioned shortcomings in which the control apparatus allows a bead mattress to be operated normally, as occasion calls, even if its temperature exceeds a predetermined level, for instance, 40° C. and assures functional safety even when the temperature thereof reaches such a high level again after it has fallen to normalcy.

A control apparatus for a fluidized bed is so constructed as to make the air pressurized by air pressurizing means such as a ring compressor upwardly escape through a diffuser board dotted with a number of small openings and support the human body by floating the body on a bead mattress formed with beads caused to circulate by the flow of the escaped air, the control apparatus comprising excessively high temperature detecting means such as a thermostat for use in preventing the temperature of the bead mattress from becoming excessively high by detecting the bead temperature above a predetermined level and producing an excessively high temperature warning signal such as a contact signal and load releasing means such as a load relay for continuously or intermittently cutting off an energizing circuit for means such as a motor for driving the air pressuring means while the excessively high temperature warning signal is produced, the improvement wherein the control apparatus further comprises operational instruction output means such as a push-button switch for giving instructions to energize the means for driving the air pressurizing means while the excessively high temperature warning signal is produced, closed circuit holding means such as a self-holding relay for closing and holding the energizing circuit based on the instructions above, and resetting means (the contacts of an auxiliary relay actuated by a resetting signal from the thermostat or those actuated by a timing signal from the timer relay) for resetting the operation of the closed circuit holding means using predetermined reset signal output means such as the excessively high temperature preventive thermostat or a timer relay after the closing and holding operation is performed.

DETAILED DESCRIPTION OF THE INVENTION

Figure 1A:
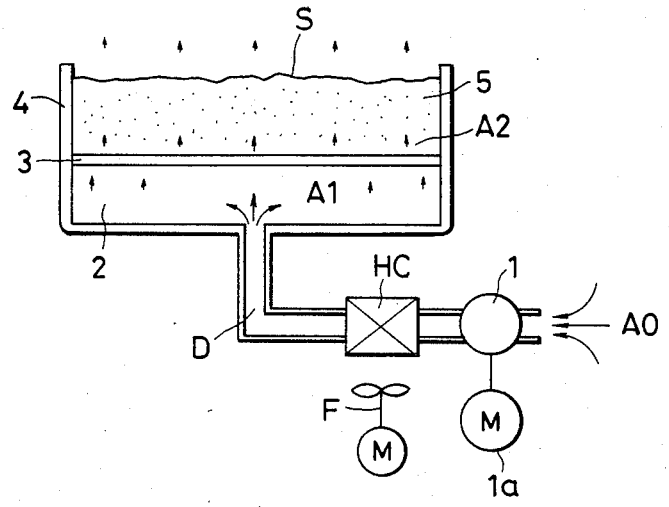
FIGS. 1(A) and 1(B) show the construction and operation of a clinic bed in the present invention.
Figure 1B:
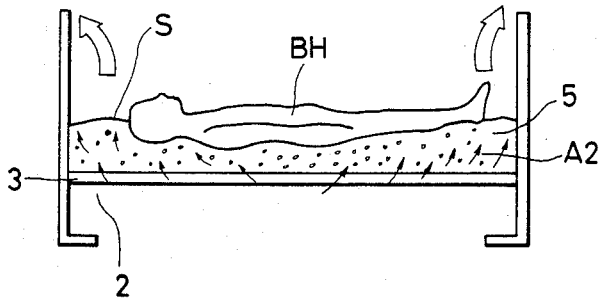
Figure 2:
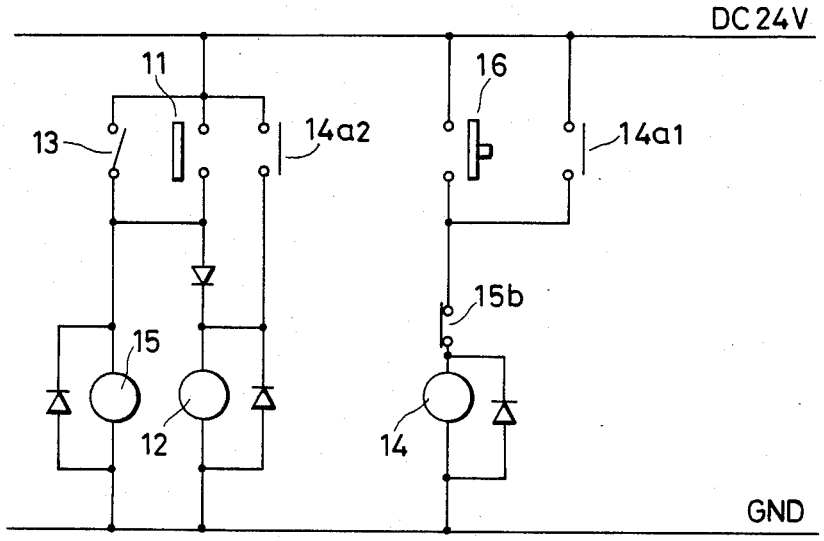
FIGS. 2 and 3 show the circuit configurations for a control apparatus embodying the present invention.
Figure 3:
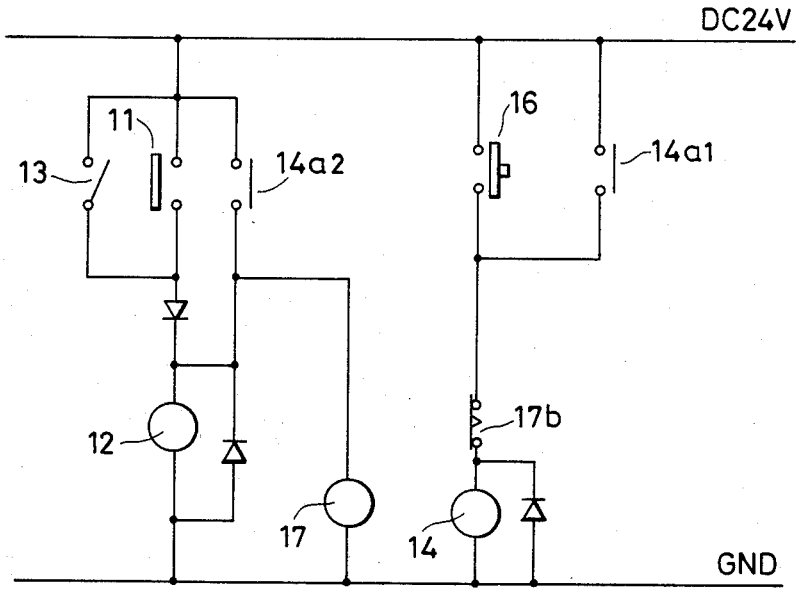

Referring now to FIGS. 2 and 3, the present invention will be described. In the drawings, like reference characters designate like or corresponding parts. In FIGS. 2 and 3, the b contacts 11 of an excessively high temperature preventive thermostat used to detect the temperature of the bead mattress 5 or the pressurized air A1 are opened when the temperature exceeds a predetermined level, for instance, 40° C. A Load relay 12, when energized, turns on a motor 1*a* for driving a ring compressor 1 through contacts a (not shown) to operate the fluidized bed. A short-circuit switch 13 is used to force, as occasion demands, the b contacts 11 of the excessively high temperature preventive thermostat to short-circuit and a self-holding relay 14 is operated by a push-button switch 16 when it is turned on, reference numerals 14*a*1, 14*a*2 being the contacts of the relay 14. There are also shown the contacts 15*b* of an auxiliary relay 15 in FIG. 2 and the contacts 17*b* of a timer relay 17 in FIG. 3.

The operation of the circuit of FIG. 2 will subsequently be described. If the temperature of the bead mattress 5 exceeds the set high level, the b contacts 11 of the excessively high temperature preventive thermostat will open, thus de-energizing the load relay 12, and the fluidizing operation will stop. Should it still be necessary to effect the normal operation under such conditions, the push-button switch 16 is pressed to energize the self-holding relay 14, which self-holds when its contacts 14*a*1 and 14*a*2 simultaneously close, causing the load relay 12 to be energized. Consequently, the fluidizing operation is restarted. After the temperature of the bead mattress 5 and the pressurized air A1 become lower than the set high level, the b contacts 11 of the excessively high temperature preventive thermostat are closed to allow the fluidizing operation to continue, whereas the contacts 15*b* are opened as the auxiliary relay 15 is energized to cause the self-holding relay 14 to be de-energized and the contacts 14*a*1 and 14*a*2 to be opened. Accordingly, the excessively high temperature preventive function of the thermostat (turning off the load relay 12 by opening the b contacts 11 of the thermostat, that is, the interruption of the circulation of the beads) is restored when the temperature of the bead mattress 5 and the pressurized air A1 exceeds the set high level again.

The short-circuit switch 13, which is normally turned off, is used when the fluidizing operation is conducted at above the set high temperature level under the surveillance of the operator without utilizing the excessively high temperature preventive function of the thermostat.

The operation of the circuit of FIG. 3 is similar to that of FIG. 2 until the self-holding relay 14 self-holds to cause the fluidizing operation to be started by turning on the push-button switch 16 after the b contacts 11 of the excessively high temperature preventive thermostat are opened. Subsequently, the timer relay 17 is energized after that time and the timing operation is started. The self-holding relay 14 is de-energized when the contacts 17*b* of the timer relay 17 are opened after the alloted time has expired, whereas the load relay 12 is de-energized when the contacts 14*a*1 and 14*a*2 are opened. Consequently, the fluidizing operation is interrupted and the state prior to where the push-button 16 is turned on is resumed. Then the temperature of the bead mattress 5 and the pressurized air A1 is lowered and the normal fluidizing operation is restarted when the b contacts 11 of the excessively high temperature preventive thermostat are closed.

Either of the circuit of FIG. 2 or FIG. 3 may be adopted depending on the circumstances. Moreover, it is possible to restore the normal condition by de-energizing the self-holding relay 14, provided that both the circuits of FIGS. 2 and 3 are used, at the earlier one of the time when the timer relay 17 is up and the time when the b contacts 11 of the excessively high temperature preventive thermostat are closed.

As set forth above, the fluidizing operation is allowed to be conducted, if necessary, according to the present invention by short-circuiting the opened contacts of an excessively high temperature preventive thermostat through a self-holding relay even when a load relay is caused to be de-energized by the opening of the contacts of the excessively high temperature preventive thermostat as the temperature of a bead mattress and pressurized air exceeds a predetermined high level and thus the fluidizing operation is interrupted, whereas the self-holding state of the self-holding circuit is made releasable when the opened contacts of the excessively high temperature preventive thermostat is reset (closed) or the time measured by a timer relay is up. Accordingly, when the temperature of the bead mattress acquires a high temperature again, causing the contacts of the excessively high temperature preventive thermostat to reopen after the temperature has dropped and the contacts have been closed, the protective function due to the opening can be restored and the fluidizing operation is interrupted.

What is claimed is:

1. In a control apparatus for a clinic bed so constructed as to make air pressurized by air pressurizing means upwardly escape through a diffuser board dotted with a number of small openings and to support a human body by floating the body on a bead mattress formed with beads caused to circulate by the flow of the escaped air, said control apparatus comprising excessively high temperature detecting contacts responsive to the detection of a bead temperature exceeding a predetermined level and responsive to the production of an excessively high temperature warning signal and for deenergizing load means for driving said air pressurizing means while said excessively high temperature warning signal is produced, the improvement of operational instruction output means for giving instructions concerning energizing said means for driving said air pressurizing means while said excessively high temperature warning signal is produced, closed circuit holding means for closing and holding said load means according to said instructions, and resetting means for resetting the operation of said closed circuit holding means through reset signal output means after the closing and holding operation is performed.

2. A control apparatus for a clinic bed as claimed in claim 1, wherein said reset signal output means detects that said excessively high temperature warning signal has been cut off as said bead temperature becomes lower than said predetermined level.

3. A control apparatus for a clinic bed as claimed in claim 1, wherein said reset signal output means measures a predetermined time to produce a timing signal after said closed circuit holding means has started said closing and holding operation.

4. A control apparatus for a clinic bed as claimed in claim 2, wherein said reset signal output means includes an auxiliary relay.

5. A control apparatus for a clinic bed as claimed in claim 3, wherein said reset signal output means includes a timer relay.

* * * * *